US005336070A

United States Patent [19]

Fujiwara et al.

[11] Patent Number: 5,336,070

[45] Date of Patent: Aug. 9, 1994

[54] FLUID COMPRESSOR HAVING ROLLER BEARING

[75] Inventors: Takayoshi Fujiwara, Tokyo; Masayuki Okuda, Kanagawa; Takashi Honjo, Tokyo, all of Japan

[73] Assignee: Kabushiki Kaisha Toshiba, Kawasaki, Japan

[21] Appl. No.: 128,646

[22] Filed: Sep. 30, 1993

[30] Foreign Application Priority Data

Jan. 29, 1993 [JP] Japan ..... 5-013521

[51] Int. Cl.[5] ..... F01C 21/08

[52] U.S. Cl. ..... 418/220; 417/356

[58] Field of Search ..... 418/220; 417/356

[56] References Cited

U.S. PATENT DOCUMENTS 5,125,805 6/1992 Fujiwara et al. ..... 417/356

5,242,287 9/1993 Fujiwara ..... 418/220

*Primary Examiner*—Richard A. Bertsch

*Assistant Examiner*—Charles G. Freay

*Attorney, Agent, or Firm*—Cushman, Darby & Cushman

[57] ABSTRACT

A fluid compressor comprises a cylinder and a columnar rotating body synchronously rotated by a drive means, The rotational movement of the cylinder and the columnar rotating body is supported by a pair of roller bearing assemblies. A clearance is provided between the roller bearing assemblies and bearing members to allow fluid from the compression chambers to pass into an interior of the casing of the compressor. With the arrangement of roller bearing assemblies at the ends of cylinder and columnar rotational body combinations, a large diameter of the cylinder is possible and thus high compression efficiency of the fluid compressor is achieved.

18 Claims, 2 Drawing Sheets

FLUID COMPRESSOR HAVING ROLLER BEARING

BACKGROUND OF THE INVENTION

1. Field of the Invention

The present invention relates to a fluid compressor and more particularly, to a helical blade type compressor for compressing refrigerant gas in a refrigeration cycle.

2. Description of the Related Art

It is known to use a helical blade type compressor for compressing fluids and/or gases. A compressor of this type is disclosed in U.S. Pat. No. 4,871,304 assigned to the present assignee. The compressor has a compression section driven by a motor and arranged in a closed case. The compression section is provided with a cylinder rotated together with a rotor in the motor. A piston having a center axis eccentric to the axis of the cylinder is rotatably housed in the cylinder. A spiral or helical groove is formed on the outer circumference of the piston in the axial direction thereof. The pitches of this spiral groove gradually narrow with the distance from one end of the piston to the other end. A blade having appropriate elasticity is fitted into the spiral groove.

The space between the cylinder and the piston is partitioned into a plurality of compression chambers by the blade. The volumes of the compression chambers gradually decrease with the distance from a suction side of the cylinder to a discharge side of the cylinder. When the cylinder and the piston are rotated in synchronization with each other by the motor, refrigerant gas in the refrigeration cycle in which the compressor is located is sucked into the compression chamber through the suction side of the cylinder. The gas thus sucked is successively fed to the compression chambers located on the discharge side of the cylinder while being compressed in the compression chambers. The compressed gas is then discharged into the closed case though the discharge end of the cylinder.

To increase the efficiency of the compressor without enlarging the size of the outer case, the diameter of the cylinder could be enlarged so that the volumes of the compression chambers are increased. As a result, more material can be compressed with each rotation of the rotor. However, increasing the diameter of the cylinder also requires increasing the diameter of the bearing members supporting the cylinder ends. As a result, the circumferential inner surface contact area at the right and left ends of the cylinder between the cylinder and bearing members is also increased. This increase in contacting surface area causes an increase in the friction between the cylinder and bearing members. A large drive force is thus needed to rotate the cylinder and piston to compensate for the increase in friction. Thus, smooth rotation of both the cylinder and the piston does not always occur due to the friction.

SUMMARY OF THE INVENTION

An object of the present invention is to provide a compact fluid compressor having a high compression efficiency and smooth rotation of both the cylinder and rotating body.

This object is achieved by providing a fluid compressor comprising a cylinder disposed with a closed casing. The cylinder has at least one discharge end out of which compressed material is expelled from the cylinder. A columnar rotating body, supported at each end by a bearing member, is positioned within the cylinder. The rotating body includes a spiral groove along its outer periphery and a spiral blade positioned within the groove. The spiral blade partitions the space between the rotating body and cylinder into a plurality of compression chambers. The pitch of the groove narrows such that the volume of each successive compression chamber decreases toward the discharge ends of the cylinder. A motor rotates the cylinder and rotating body synchronously. Operating fluid is provided to the compression chambers and compressed as the fluid travels through successive compression chambers during the rotation of the rotating body. A roller bearing assembly is provided between at the discharge ends of the cylinder between the interior surface of the cylinder and the bearing members, thus reducing the friction between the inner surface of the cylinder and the bearing member as the cylinder rotates. The compressed fluid is expelled from the discharge ends of the cylinder through the roller bearing assemblies. Thus, the diameter of cylinder is increased while reducing the friction between the ends of the cylinder and the bearing members.

BRIEF DESCRIPTION OF THE DRAWINGS

The accompanying drawings, which constitute a part of the specification, illustrate a presently preferred embodiment of the invention, and together with the general description given above and detailed description of the preferred embodiment given below, explain the principles of the present invention.

DETAILED DESCRIPTION OF THE PREFERRED EMBODIMENT

An embodiment of the present invention will now be explained with reference to the accompanying drawings.

Figure 1:
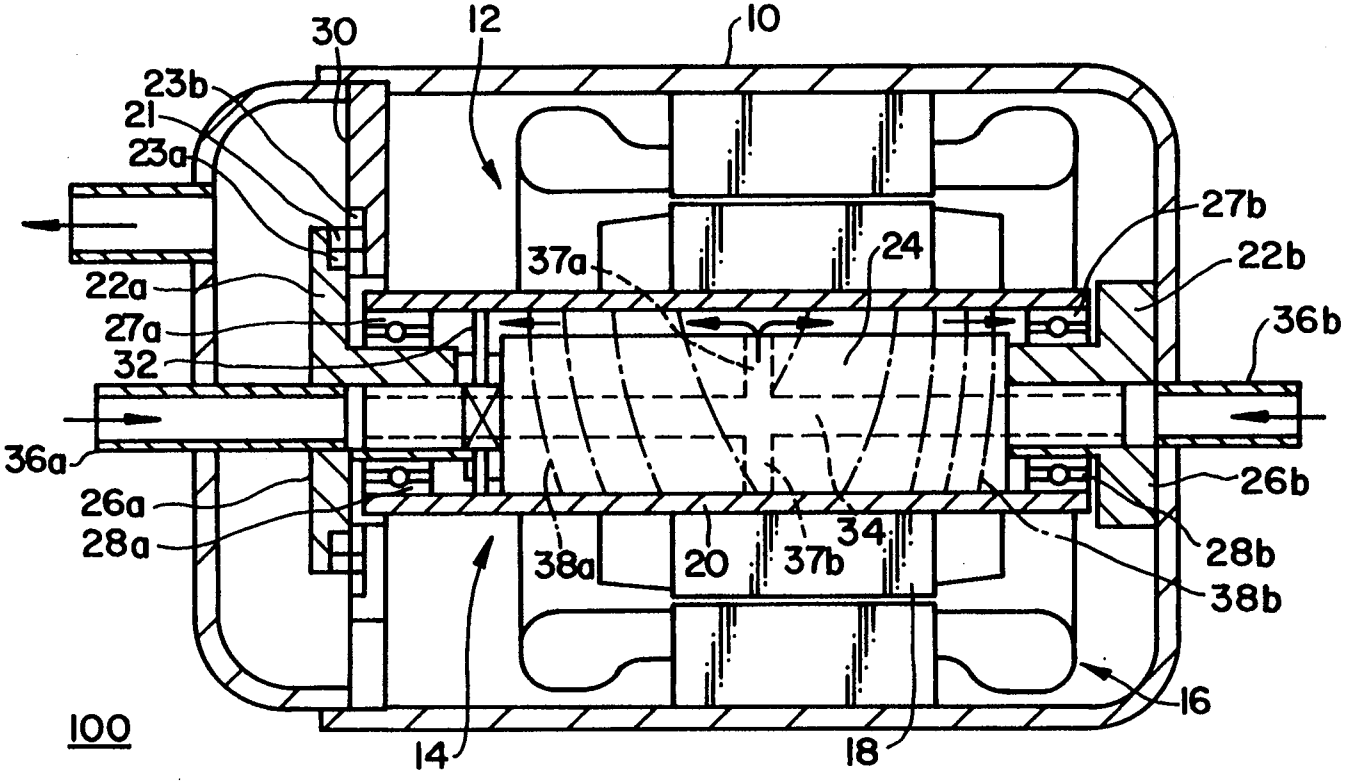
FIG. 1 is a sectional view showing a compressor according to the present invention.
Figure 2:
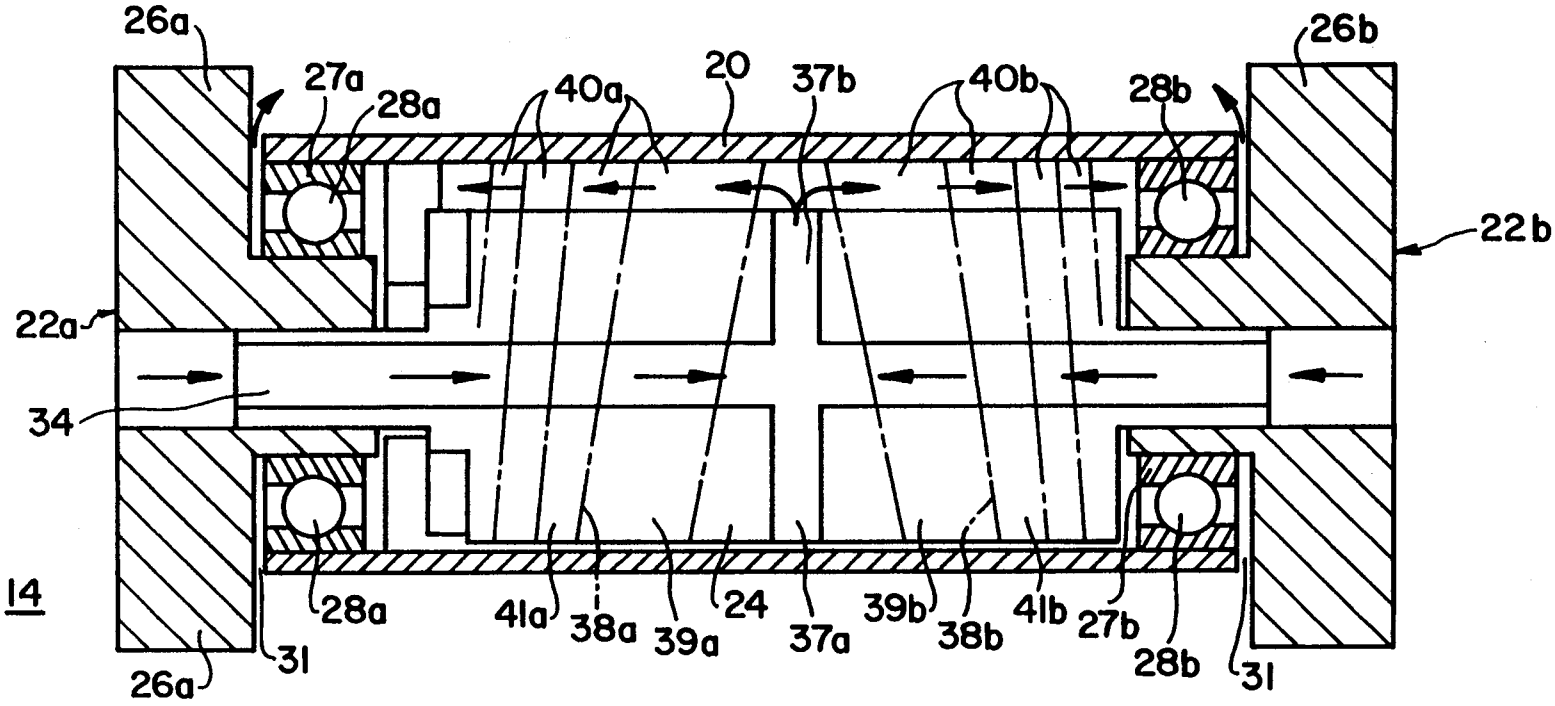
FIG. 2 is an enlarged sectional view of the rotating body and bearing means of the compressor.

FIG. 1 shows a preferred embodiment for a helical blade type compressor 100 according to the principles of the present invention. The compressor 100 compresses a refrigerant in a refrigeration cycle. FIG. 2 is a detailed view of a portion of the compressor 100 of FIG. 1.

Compressor 100 includes a closed case 10, a motor section 12 and a compression section 14, both of which are arranged in case 10. Motor section 12 includes a ring-shaped stator 16 fixed to the inner face of case 10 and a ring-shaped rotator 18 located inside a stator 16.

Compression section 14 includes a cylinder 20. The rotor 18 is coaxially fixed to the outer circumference of the cylinder 20. Both ends of cylinder 20 are rotatably supported by bearing means **22*a*, 22*b*. A columnar rotating body 24 having a diameter smaller than that of cylinder 20 is arranged in cylinder 20 and extends between bearing means 22*a* and 22*b*. Rotating body 24 has a center axis offset from the axis of cylinder 20. Part of the outer circumference of rotating body 24 is in contact with the inner circumference of cylinder 20. Bearing means 22*a* and 22*b* comprises of bearing members 26*a*, 26*b* and roller bearing assemblies 27*a*, 27*b*, including, for example, ball bearings 28*a*, 28*b*. Bearing member 26*a* is supported by a support member 30 so as to be movable in the radial direction of cylinder 20 by ring member 21 engaging slot 23***a* formed in bearing member 26*a* and slot 23*b* formed in support member 30. Support member 30 is fixed to case 10. Bearing member 26, on the other hand, is directly fixed to case 10. Ball bearings 28*a*, 28*b* are provided between the inner surface of cylinder 20 and the outer surface of bearing members 26*a*, 26*b*. More specifically, the left end portion of cylinder 20, which is a first discharge end thereof, is rotatably fitted onto ball bearing 28*a* while the right end portion, which is a second discharge end thereof, is rotatably fitted onto ball bearing 28*b*. The left end portion of rotating body 24 has a diameter that is smaller than the middle portion thereof and is rotatably supported by bearing member 26*a*. The right end portion of rotating body 24 also has a diameter that is smaller than the middle portion thereof and is rotatably supported by bearing member 26*b*. Cylinder 20 and rotator 18 fixed thereto are supported, coaxial to stator 16, by bearing means 22*a*, 22*b*. As shown in FIG. 2, a clearance 31 is provided between ends of bearing assemblies 27*a*, 27*b* and the surfaces of bearing members 26*a*, 26*b*.

Cylinder 20 and rotating body 24 are connected to each other through an Oldahm's mechanism 32 which serves as rotational transmitting means. When motor section 12 is energized to rotate cylinder 20 together with rotor 18, the rotating force of cylinder 20 is transmitted to rotating body 24 by means of the Oldahm's mechanism 32. As a result, rotating body 24 is rotated in cylinder 20 while the outer circumference thereof is partially in contact with the inner circumference of cylinder 20.

A first groove (not shown) is formed on the other circumference of rotating body 24, extending from the middle portion of rotating body 24 to the left end thereof. A second groove (not shown) is also formed on rotating body 24 extending from the middle portion of rotating body 24 to the right end thereof. The pitches of the first and second grooves gradually become narrower at a certain rate with the distance from the middle portion of rotating body 24 to the left and right ends thereof. The first and second grooves have the same number of turns, but the turns of the first groove are in a direction opposite the turns of the second groove. The first and second grooves have starting ends (not shown) positioned near the middle of rotating body 24. The starting ends are set apart from each other by 180° in the circumferential direction of rotating body 24. Each groove has a width and depth which are uniform throughout its length, and the side faces of each groove are perpendicular to the longitudinal axis of rotating body 24.

Rotating body 24 has a suction passage 34, extending from the right and left ends of the rotating body 24 to the middle thereof. Both ends of suction passage 34 communicate with suction tubes 36*a*, 36*b* of the refrigerating cycle, respectively. Suction passage 34 communicates with first and second suction ports 37*a* and 37*b* at the middle portion of rotating body 24.

First and second spiral blades 38*a*, 38*b* (shown by dotted lines) are fitting in the first and second grooves, respectively. Blades 38*a*, 38*b* are formed of elastic material and can be fitted into the corresponding grooves by utilizing their elasticity. The thickness of each of blades 38*a*, 38*b* is substantially equal to the width of the corresponding groove. Each portion of blades 38*a*, 38*b* is movable to the radial direction of rotating body 24 along the corresponding groove. The outer circumference of each of blades 38*a*, 38*b* is in contact with the inner circumference of cylinder 20.

As shown in FIG. 2, the space defined between the inner circumference of cylinder 20 and the outer circumference of rotating body 24, extending from the middle of cylinder 20 to the first discharge side thereof, is partitioned into a plurality of compression chambers 40*a* by the first blade 38*a*. Each compression chamber is substantially crescent-shaped and extends along blade 38*a* from the contact portion between rotating body 24 and the inner circumference of cylinder 20 to the next contact portion. The volumes of the compression chambers 40*a* are reduced gradually with distance from the middle of cylinder 20 toward the first discharge side thereof.

Similarly, the space defined between the inner circumference of cylinder 20 and the outer circumference of rotating body 24, extending from the middle of cylinder 20 to the second discharge side thereof, is partitioned into a plurality of compression chambers 40*b* by second blade 38*b*. Each compression chamber is substantially crescent-shaped and extends along blade 38*b* from the contact portion between rotating body 24 and inner circumference of cylinder 20 to the next contact portion. The volumes of the compression chambers 40*b* are reduced gradually with distance from the middle of cylinder 20 toward the second discharge side thereof, The following is a description of the operation of the compressor 100 constructed in accordance with the description given above.

When motor section 12 is switched on, rotator 18 rotates together with cylinder 20. The rotational force of cylinder 20 is transmitted to rotating body 24 through Oldahm's mechanism 32, causing the rotating body 24 to rotate in synchronization with cylinder 20. Rotating body 24 is thus rotated while its outer circumference is partially in contact with the inner circumference of cylinder 20. First and second blades 38*a*, 38*b* are also rotated together with rotating body 24.

Blades 38*a*, 38*b* rotate while keeping their outer circumference in contact with the inner circumference of cylinder 20. Therefore, they are pushed into the corresponding grooves as they approach the contact portions between the outer circumference of rotating body 24 and the inner circumference of cylinder 20, and emerge from the grooves as they go away from the contact portions. When compression section 14 is operative, refrigerant gas is sucked into cylinder 20, passing through suction tubes 36*a*, 36*b*, passage 34 and first and second suction ports 37*a*, 37*b*. This gas is confined in a first compression chamber 39*a* defined between the first and second turns of the first blades 38*a* and in a first compression chamber 39*b* defined between the first and second turns of the second blade 38*b*. As rotating body 24 rotates, the gas in compression chamber 39*a* is successively fed into the next compression chamber 41*a* while being confined between the two adjacent turns of blade 38*a*. Similarly, the gas in compression chamber 39*b* is successively fed into the next compression chamber 41*b* while being confined between the two adjacent turns of blade 38*b*. The volumes of compression chambers 40*a* are gradually reduced with the distance from the middle of cylinder 20 to the first discharge end thereof, while the volumes of the compression chambers 40*b* are gradually reduced with distance from the middle of cylinder 20 to the second discharge end. Therefore, the gas confined in compression chambers 40*a* is gradually compressed as it is delivered to the first discharge end of cylinder 20, while the gas confined in compression chambers 40*b* is gradually compressed as it is delivered to the second discharge end of cylinder 20. The compressed gas fed from compression chambers 40*a*, 40*b* passes through the roller bearing assemblies 27*a*, 27*b* and is guided into case 10 though clearance 31.

According to a preferred embodiment of the present invention, ball roller bearings such as ball bearings 28*a*, 28*b* are employed to support cylinder 20 having a relatively large diameter. This large diameter enables a high compression efficiency to be achieved in compressor 100 since the volumes of compression chambers 40*a*, 40*b* are increased with the enlargement of the diameter of cylinder 20. Both ends of cylinder 20 do not have an air-tight seal, but instead are closed by bearing means 22*a*, 22*b*. Ball bearings 28*a*, 28*b* in roller bearing assemblies 27*a*, 27*b* allow the compressed gas to flow through bearing assemblies 27*a*, 27*b*. The gas then passes through clearance 31 defined between roller bearing assemblies 27*a*, 27*b* and bearing members 26*a*, 26*b*. The operation of compressor section 14 is improved as compared to compressors of the type shown in U.S. Pat. No. 4,872,304. According to the embodiment described above, starting ends of the first and second spiral grooves on rotating body 24 are set apart from each other by 180° in the circumferential direction of rotating body 24. As a result, the gas compressed in compression chambers 40*a*, 40*b* are alternately compressed and alternately discharged. Therefore, the thrust forces heading from the first and second discharge ends of cylinder 20 to the middle thereof are balanced. This prevents the rotating body 24 from being displaced to push its end faces against bearing means 22*a*, 22*b*.

The volume of the compression chambers in the compressor described above gradually decrease from the middle of the rotating body to the end thereof. However, the present invention can be applied to a compressor wherein the volumes of the compression chambers are gradually increased from the middle of the rotating body to both ends thereof. In this second embodiment of the present invention, the flow of the operating fluid is reversed so that the compressed fluid exits from the ends of the rotating body.

In a third embodiment of the present invention, the volumes of the compression chambers decrease along the entire length of the rotating body from a first end to a second end thereof. Thus, only one spiral groove and associated blade are required. In this embodiment, a first end of the rotating body is sealed with respect to the cylinder to prevent the operating fluid from escaping from the first end thereof. The second end of the cylinder is the discharge end and includes a roller bearing assembly between the inner surface of the cylinder and the associated bearing member. The compressed fluid exits through the roller bearing assembly. Suction ports are positioned proximate to the sealed first end. In operation, the operating fluid enters the compression chamber associated with the first end of the rotating body. It is compressed in the compression chambers along the length of the rotating body and discharged through the roller bearing assembly positioned at the discharge end of the cylinder. It is to be understood that the orientation of the volumetric decrease of the compression chambers can be reversed so that the compressed fluid is discharged from the suction ports at the first end of the rotating body.

It is to be understood that the compressor of the present invention can be used in various types of systems and is not limited in application to refrigerating cycles.

Additional advantages and modifications will readily occur to those skilled in the art. Accordingly, various modifications may be without departing from the spirit or scope of the general inventive concept as defined by the appended claims.

What is claimed is:

1. A fluid compressor comprising:

a closed casing;

a cylinder disposed within said closed casing, said cylinder having at least one discharge end;

a columnar rotating body located inside said cylinder so as to extend in an axial direction of said cylinder and defining a space therebetween, said columnar rotating body including at least one spiral groove along an outer peripheral surface thereof and a spiral blade disposed within said at least one spiral groove, said spiral blade partitioning said space between said rotating body and said cylinder into a plurality of compression chambers;

drive means for rotating said cylinder and said columnar rotating body synchronously;

fluid supply means for supplying operating fluid to said compression chambers;

a bearing member rotatably supporting an end portion of said columnar rotating body with respect to said closed casing; and a roller bearing assembly located at said at least one discharge end of said cylinder between an inner circumference of said cylinder and said bearing member, said roller bearing assembly rotatably supporting said at least one discharge end of said cylinder and passing said operating fluid therethrough.

2. A fluid compressor according to claim 1, wherein said cylinder includes a first discharge end and a second discharge end.

3. A fluid compressor according to claim 2, wherein a roller bearing assembly is located at each of said first and second discharge ends of cylinder.

4. A fluid compressor according to claim 1, wherein said spiral groove has a gradually narrowing pitch in a direction toward said at least one discharge end of said cylinder such that said compression chambers gradually decrease in volume from said first portion of said rotating body toward said at least one discharge end.

5. A fluid compressor according to claim 1, wherein said fluid supply means comprises:

a suction passage provided inside said columnar rotating body; and at least one suction opening provided to said outer peripheral surface of said columnar rotating body and communicating with said suction passage.

6. A fluid compressor according to claim 1, wherein said columnar rotating body includes a first end portion rotatably supported by a first bearing member and a second end portion rotatably supported by a second bearing member, wherein said first bearing member is attached directly to said closed casing and said second bearing member is attached to a support member attached to said closed casing, said second bearing member attached to said support member such that said second bearing member is movable in a radial direction with respect to said cylinder.

7. A fluid compressor according to claim 1, wherein said roller bearing assembly includes ball bearings.

8. A fluid compressor according to claim 3, wherein said columnar rotating body includes:

first and second spiral grooves extending from a central portion of said columnar rotating body toward said first and second discharge ends of said cylinder, respectively; and first and second spiral blades respectively disposed within said first and second spiral grooves.

9. A fluid compressor according to claim 8, wherein said first and second grooves have pitches gradually decreasing from said central portion of said columnar rotating body toward said first and second discharge ends of said cylinder, respectively.

10. A fluid compressor according to claim 9, wherein said first and second grooves have starting ends provided in said central portion of said columnar body and set apart by 180° in a circumferential direction of said columnar rotating body.

11. A fluid compressor according to claim 9, wherein said fluid supply means comprises:

a suction passage provided inside said columnar rotating body; and at least one suction opening provided to an outer circumference of said columnar rotating body and communicating with said suction passage.

12. A fluid compressor according to claim 11, wherein said at least one suction opening comprises first and second suction ports opened to said outer peripheral surface of said columnar rotating body and located at said central portion of said columnar body.

13. A fluid compressor according to claim 11, wherein said columnar rotating body includes a first end portion rotatably supported by a first bearing member and a second end portion rotatably supported by a second bearing member, wherein said first bearing member is attached directly to said closed casing and said second bearing member is attached to a support member attached to said closed casing, said second bearing member attached to said support member such that said second bearing member is movable in a radial direction with respect to said cylinder.

14. A fluid compressor according to claim 13, wherein said roller bearing assemblies include ball bearings.

15. A fluid compressor according to claim 14, wherein said first and second grooves have starting ends provided in said central portion of said columnar body and set apart by 180° in a circumferential direction of said columnar rotating body.

16. A fluid compressor according to claim 15, wherein said columnar rotating body is eccentrically located within said cylinder.

17. A fluid compressor according to claim 16, wherein said first and second spiral blades have the same number of turns with opposite turning directions.

18. A fluid compressor according to claim 17, wherein said drive means comprises a stator attached to said closed casing and a rotor rotatably positioned within said stator and coaxially affixed to an outer circumference of said cylinder.

* * * * *